United States Patent [19]

Kolar

[11] 4,285,148

[45] Aug. 25, 1981

[54] UNIVERSAL ROUND CLOCK CALENDAR

[75] Inventor: Karel Kolar, Prague, Czechoslovakia

[73] Assignee: Racionalizacni a experimentalni laborator, Prague, Czechoslovakia

[21] Appl. No.: 95,998

[22] Filed: Nov. 20, 1979

[30] Foreign Application Priority Data

Nov. 20, 1978 [CS] Czechoslovakia ..... 7555-78

[51] Int. Cl.[3] ..... G09D 3/08; G09D 3/00

[52] U.S. Cl. ..... 40/115; 40/107

[58] Field of Search ..... 40/115, 113, 107, 109, 40/110, 111

[56] References Cited

U.S. PATENT DOCUMENTS

| | | | |
|---|---|---|---|
| 641,433 | 1/1900 | Buell | 40/109 |
| 902,484 | 10/1908 | Ferreres | 40/113 |
| 1,894,470 | 1/1933 | Mathers | 40/115 |
| 2,409,347 | 10/1946 | Dootson | 40/113 |
| 2,537,693 | 1/1951 | Nono | 40/113 |
| 2,755,581 | 7/1956 | Johnson | 40/111 |
| 3,190,022 | 6/1965 | Maitre | 40/113 |

*Primary Examiner*—Robert Peshock
*Assistant Examiner*—Michael J. Foycik, Jr.

[57] ABSTRACT

Universal round calendar of a simple design which may be employed for various calendar systems. It provides traditional sequences of data and their intelligible and quick readjustment on another desired date. The universal round calendar may be employed as a part of a pocket watch or wrist watch without the necessity of any adaptation of the design of the watch mechanism, or it may be used as a complement of electronic digital watches. It also provides a direct function coupling between a calendar and a watch. The calendar, according to the invention, consists of two mutually revolving discs carrying indication marks for calendar data, the mutual position of which corresponding with the desired month in any range of years, is set up according to the code marking of the desired actual month.

11 Claims, 12 Drawing Figures

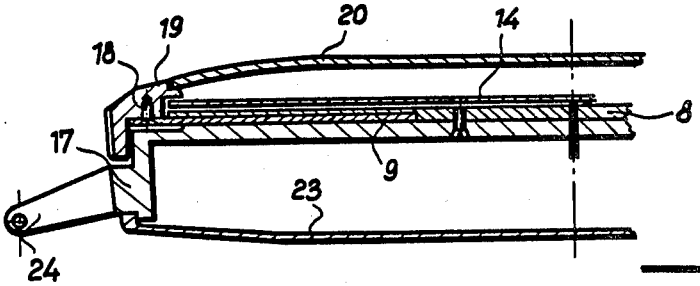
FIG-5
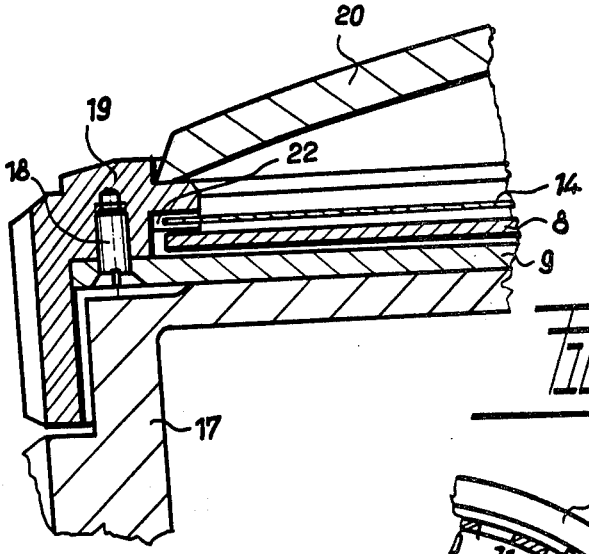
FIG-6
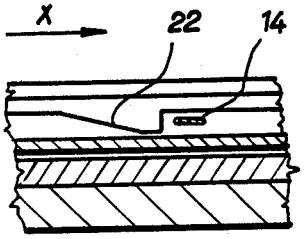
FIG-7
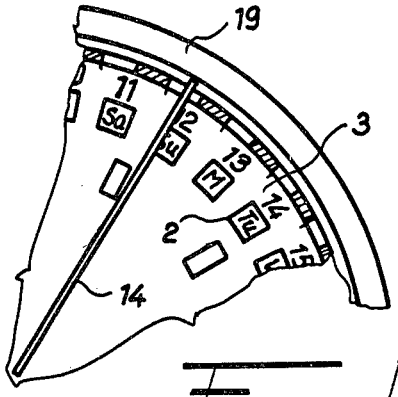
FIG-8
| | 1 2 3 | 4 5 6 | 7 8 9 | 10 11 12 |
|---|---|---|---|---|
| 1975 | 1 2 2 | 3 6 0 | 3 4 5 | 1 2 5 |
| 1976 | 6 0 5 | 6 2 3 | 6 0 1 | 4 5 1 |
| 1977 | 2 3 3 | 4 0 1 | 4 5 6 | 2 3 6 |
| 1978 | 0 1 1 | 2 5 6 | 2 3 4 | 0 1 4 |
| 1979 | 5 6 6 | 0 3 4 | 0 1 2 | 5 6 2 |
| S | 0 1 4 | 0 1 4 | 0 1 4 | 0 1 4 |
FIG-9

UNIVERSAL ROUND CLOCK CALENDAR

This application is related to applicant's co-assigned U.S. patent application Ser. No. 96,057, filed contemporaneously herewith.

There are known round calendars which make it possible to evaluate calendar data in the range of a determined number of years. These known round calendars usually have a drawback, viz. that marks for leap years and ordinary years are not common, and that is why they include 14 marks of months; the traditional sequence of years and months is also not maintained; this causes an absence of an easy survey and difficult dial reading. Moreover, an effort to combine two-time measuring devices, viz. a calendar and a watch, has resulted in special solutions of devices for the mechanical date indication which are rather complicated and not very easily read, and their manipulation by means of a complicated control mechanism and gearing is difficult.

The invention provides a universal calandar which may be used for various calendar systems, which provides a traditional sequence of data, their intelligible and accurate reading, and a quick readjustment for another desired date.

A universal round calendar, according to the invention, may be employed as a part of a watch without any adaptation of the watch design, and which provides a direct functional dependence between the calendar and the watch.

The principle of the invention resides in the use of two concentric mutually rotating disks with circumferentially arranged scales of calendar data. In preferred embodiments the names of days are arranged on a lower disk, viz. on its circumference, and on the upper disk there is arranged a row of 31 view slits with respective members of a row of digital calendar data. The row of view slits is circumferentially divided into two parts, the first part of which comprises an odd number (especially 17) of members is situated on an inner circle (or alternatively on an outer circle), the second part comprising an even number of the remaining members up to 31 (especially 14) being situated on an outer circle (or alternatively on an inner circle). Alternatively the view slits for members of a row of names of days are disposed on the circumference of the upper disk in a system of 35 orientation divisions. On the upper disk there is also disposed, a view slit for 7 members of a calendar code (or names of days), the value of which for the desired month and year is disposed in a tabular manner on a visible surface of the calendar (e.g., on the upper disk, the dial, glass, lower lid, or band of the watch). On the lower disk there is arranged a scale of names of days, circumferentially divided into two parts having each part having six members more than the respective part of the scale of digital calendar data and view slots (especially 23 and 22 members), respectively on identical circles of the same dimensions as view slits on the upper disk. Alternatively the scale of names of days may be disposed in a continuous row on only one circle in a system of 35 orientation divisions, and then on the lower desk there are disposed 35 marks of the calendar code or names of days.

In comparison with hitherto known solutions, the calendar, according to the invention, is of a simpler design, but moreover, it is more universal, more easily intelligible and more easily operatable. When applied to a watch, it is an advantageous complement which does not affect the design of the watch, and it is rather quicker and more advantageous in use than the most exacting solutions of electronic digital watches. A further advantage of the calendar, according to the invention, resides in the fact that calendar data may be evaluated simultaneously in two or more calendar systems; this is not possible with hitherto known calendars.

In order that the invention may be clearly understood and readily carried into effect, a preferred embodiment thereof is, by way of example, hereinafter more fully described and illustrated in the accompanying drawings in which:

FIG. 5 is a fragmentary view in a section of a watch housing having a revolving glass carrier;

FIG. 6 is a fragmentary view in cross section of a detail of the revolving glass carrier of FIG. 5;

FIG. 7 is a fragmentary view in section illustrating a single-direction claw for moving a date pointer;

FIG. 8 is a fragmentary view in plan of a dial having a continuously moving pointer;

FIG. 9 illustrates an example of a code marking of respective months in a selected interval of years;

Figure 1:
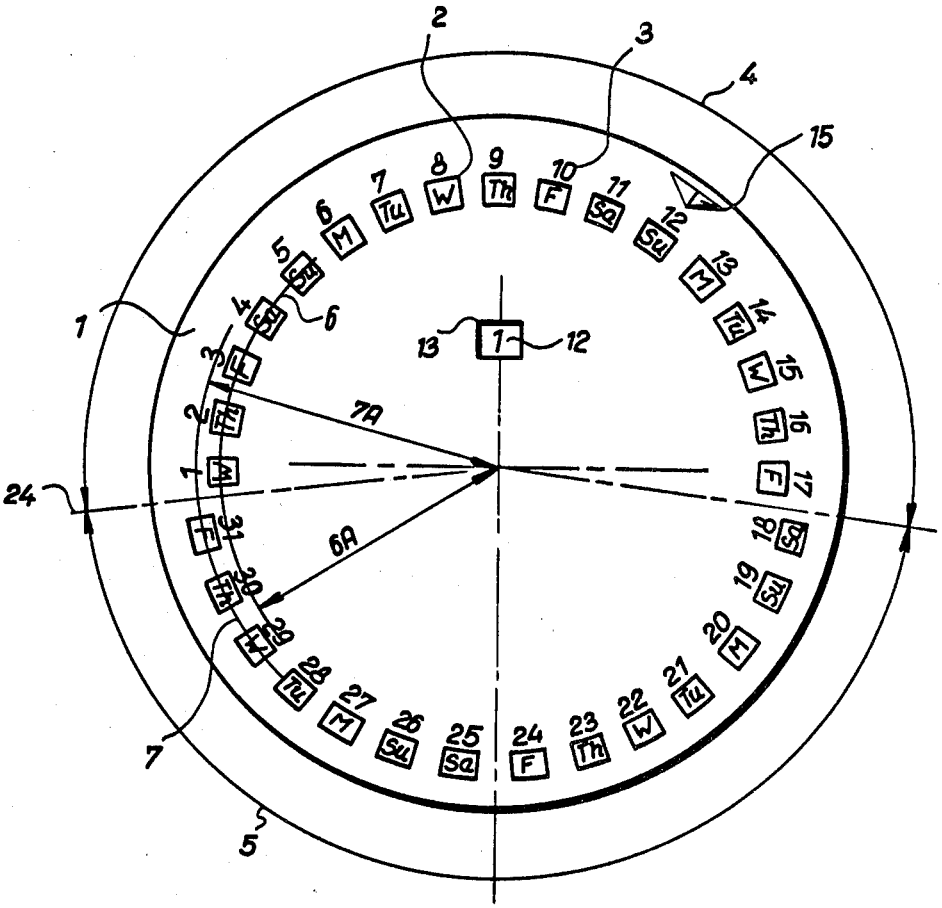
FIG. 1 is a plan view to a universal round calendar, in accordance with the invention.
Figure 2:
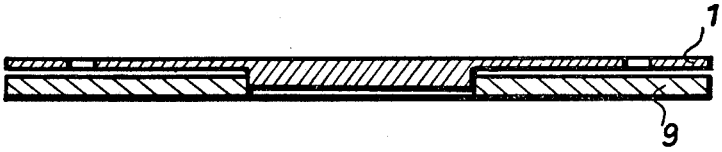
FIG. 2 is a diametral cross section of the calendar of FIG. 1.

Turning first to FIGS. 1–4 incl., there is shown a universal round calendar comprising an upper disc 1 (see FIG. 1), along the circumference of which there is arranged a row of view reading slots or apertures 2. There are 31 view slits and with each of them there corresponds an indication mark 3 of digital calendar data. As it is evident in FIG. 1, the row of view slits 2 is divided in two parts 4 and 5. One part, e.g. the first part 4, comprises an odd number of members, e.g 1 to 17, and it is here situated on an inner circle 6; the second part 5 comprises an even number of the remaining members, in this case 18 to 31, the second part 5 being disposed on an outer circle 7. Of course, the arrangement may be reversed so that the first part 4 may be situated on the outer circle 7, and then the second part will be situated on the inner circle 6.

Figure 3:
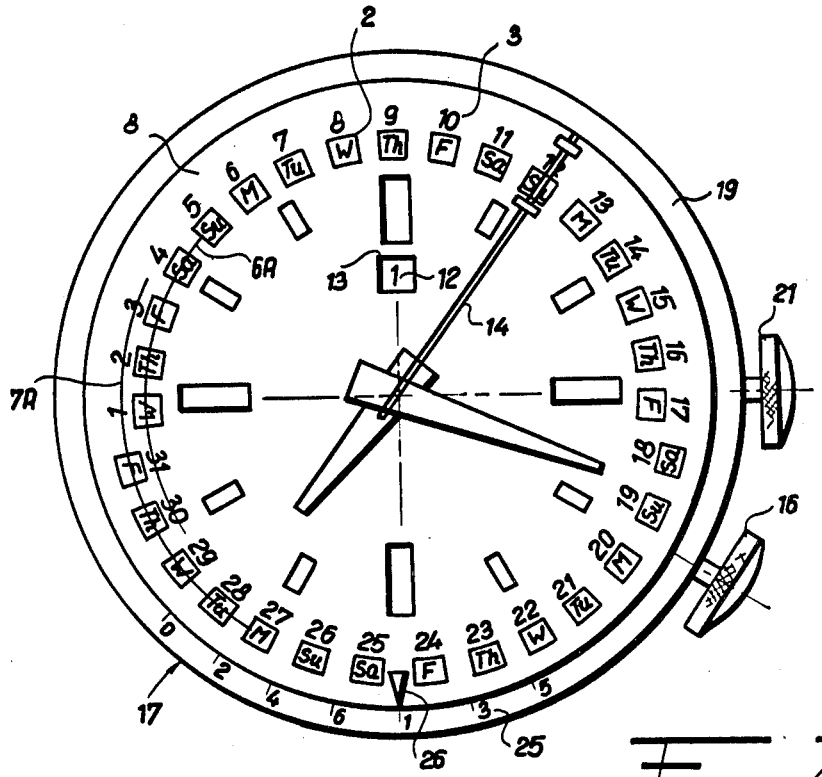
FIG. 3 is a view of the universal round calendar of FIG. 1.
Figure 4:
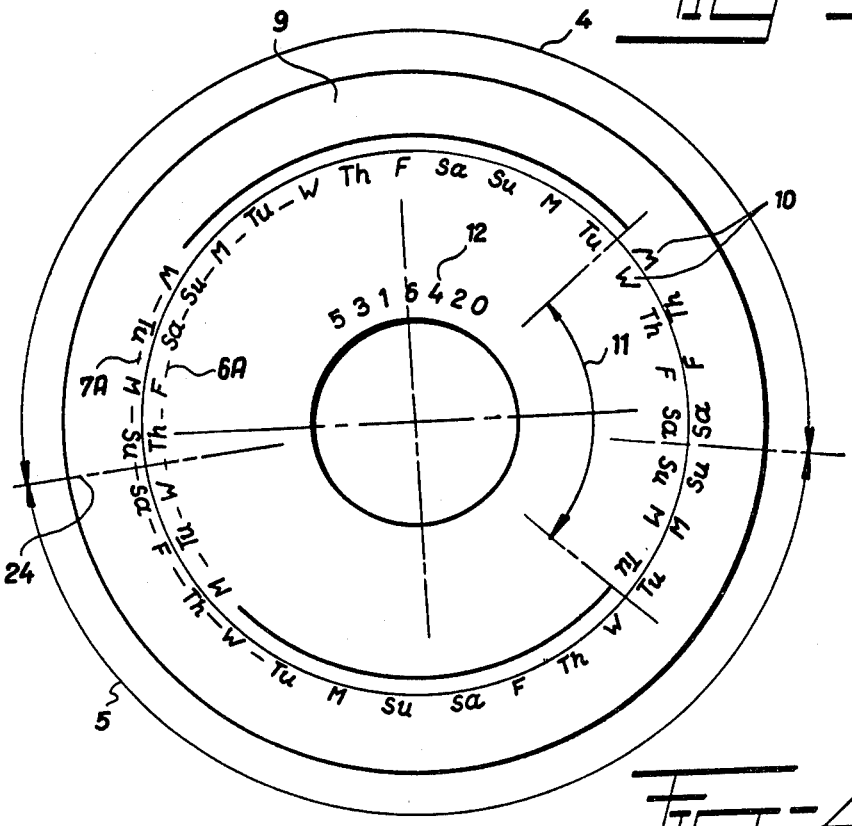
FIG. 4 is a plan view of a lower disk carrying the names of days.

The universal round calendar as a part of a watch is shown in FIG. 3, wherein the dial of a watch 8 is substantially identical with the upper disk shown in FIG. 1.

Under the upper disc 1 there is rotably mounted a concentric lower disc 9 (FIG. 4), carrying a scale 10 of indicia for the names of days. These indicia are situated on circles, identical as to dimensions 6A and 7A in FIGS. 3 and 4, with view slits 2 on the upper disc 1 (or on the dial 8); on the circle 6A there are 23 and on the circle *7a* there are 22 members in the row of a cyclical repeating of the names of days. Both parts of the scale in the meaning of indication members link up one to the other continuously in the range 11 of transition from the first part 4 to the other part 5.

On the lower disc 9 there is also marked a calendar code or a sequence of names of days 12, which serves for the correct adjustment of the disc 9. The calendar code is in fact a seven-member row of a digital marking of names of the first days of months, wherein Monday is represented by the digit 5, Tuesday by the digit 3, Wednesday by 1, Thursday by 6, Friday by 4, Saturday by 2 and Sunday by 0. The calendar code is an important means for a simple expression of interval relations of a calendar system. A desired member of this code may be read in a view slit 13 in the upper disc 1 (FIG. 1), or in the dial 8 (FIG. 3). Alternatively the calendar code or the sequence of names of days may be arranged on a revolving carrier 19 (FIG. 3) of the watch glass or directly on the glass 20 (FIG. 5) and then the respective member of a code 25 may be set up opposite a mark 26, as shown in FIG. 3.

The universal round calendar comprises an indicator for indicating the actual day. Such an indicator may be represented e.g. by a date pointer 14 (FIGS. 5–8 incl.) or by any other mechanical indicator (e.g. mechanical indicator 15 in FIG. 1), an optical indicator, or an electronic indicator. Such an indicator may be operated by hand or e.g. the date pointer 14 may be controlled by a gearing of the watch.

The motion of the disc 9 carrying the names of days is (FIG. 3) derived from a knob 16 disposed on the outer side of a housing 17 of the watch.

In FIG. 5 and FIG. 6 there is shown an alternative embodiment where in the lower disc 9, carrying the names of days, is fixed e.g. by the screw 18 with the carrier 19 of the watch glass 20, the disc 9 resolving with the glass 20 with respect to the watch housing 17.

The date pointer 14 is movable with respect to the watch mechanism by means of a mechanism (not shown), which makes such mutual movement possible. Such a mechanism may be a friction clutch. The date pointer 14 may be either revolved by means of a date knob 21 (FIG. 3) or alternatively, according to FIGS. 6 and 7, there may be arranged a single-direction claw 22 on the revolving carrier 19. Such claw, when revolving in the direction X carries with it the pointer 14. If the carrier 13 is rotated in the opposite direction, the pointer 14 springs over the claw 22 and does not move.

The motion of the indicator (e.g. pointer 14) for indicating the actual day, which is driven by the watch mechanism, may be either continuous as shown in FIG. 8, or it may be done by whole days (FIG. 3).

FIG. 9 shows an example of a table of a code marking of respective months, according to the respective calendar system, in an interval from the year 1975 up to the year 1979. The table may be adapted in any arrangement and at any place on the watch or outside it, e.g. on the glass 20, on the lower watch lid 23, on the watch band, etc. The table may comprise any number of years up to the whole range of the calendar system.

Values of members of the code marking of respective months may be replaced directly by respective abbreviations of names of the first days of months.

The calendar, according to the invention, may be employed with various calendar systems, viz. in a manner conforming with the table according to FIG. 9. As an example, in the last line of the table in FIG. 9 there are shown values for a system of a world calendar S according to a selected calendar code.

A mutual adjustment of the round closed scale 3, comprising a continuous sequence of digits 1 up to 31, and of the scale of a cyclical repeating of names of days 10 (M, Tu, W, Th, F, Sa, Su) must be, for a closed cycle, a multiple of seven; both scales must be identical as to the dimension of the graduation; this is enabled by the fact that the scale of the cyclical repeating of names of days continuously transits in the range 11 from the inner circle 6A (FIG. 4) onto the outer circle 7A. In the location 24 of the transition of the scale of the calendar data 3 from the outer circle 7A onto the inner circle 6A, the rest of the members of the scale 10 of the cyclic repeating of the names of days up to the nearest multiple of seven, i.e. 35, is covered on the circle 7A by means of the upper disc 1 (or the dial 8) under the first members of the scale 3. The beginning of the scale 10, which is shifted in advance through the respective number of members with respect to the transition 24 is covered on the circle 6A by the end of the scale 3 on the upper disc 1 (or dial 8). The transition location 24 on circles 6A and 7A (FIG. 4) is emphasized by the difference of the structure of both scales 3 and 10 at the said transition location 24.

Figure 10:
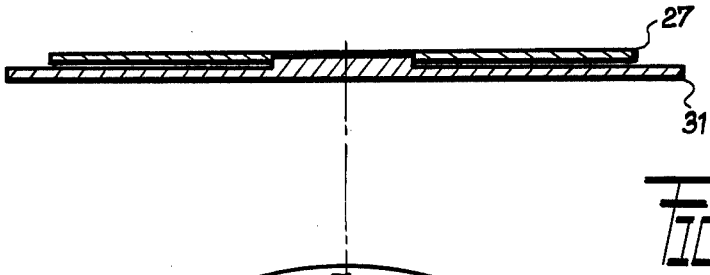
FIG. 10 is a view in diametral section of the structure shown in FIG. 11.
Figure 11:
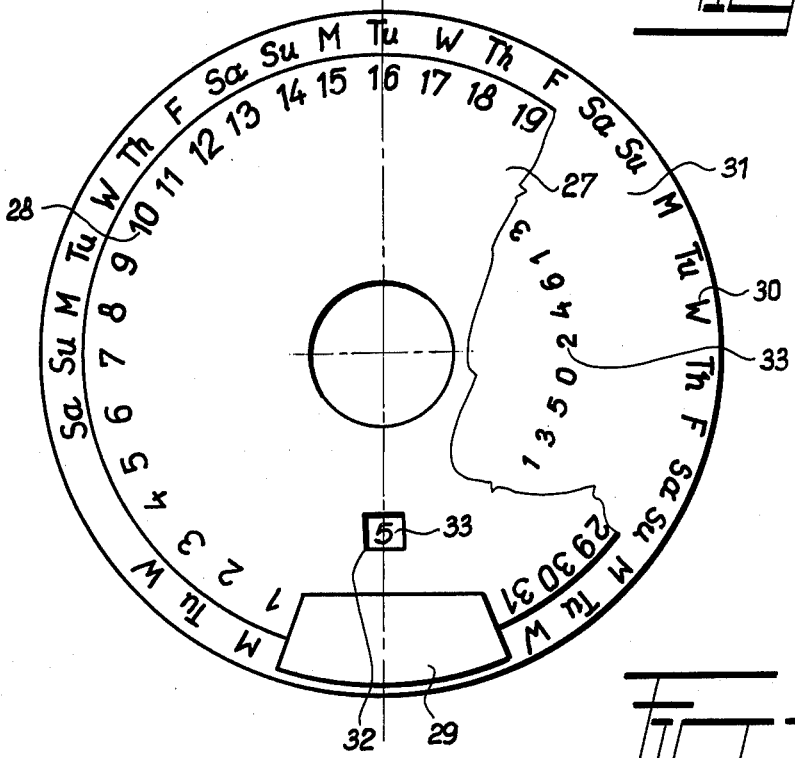
FIG. 11 is a view in plan of further embodiments of universal round calendar employing another manner of applying scales in a system having 35 orientation divisions.

An alternative embodiment, which employs scales in a system with 35 orientation divisions is shown in FIGS. 10 and 11. This device has an upper disc 27, carrying a scale 28 of digital calendar data; in the range of a gap between the number of members of the scale 28 of digital calendar data and total number of orientation divisions there is a screen 29 (FIG. 11) on the upper disc 27, which covers the respective numbers of the scale 30 of names of days in the location of the 32nd up to the 35th orientation division formed in a continuous row on the lower disc 11 which revolves with respect to the upper disc 27. On the upper disc 27 there is a view slit 32 for reading, or for setting up the respective member of the calendar code 33, formed on the lower disc 31 as a cyclicly repeated row having 35 members.

Figure 12:
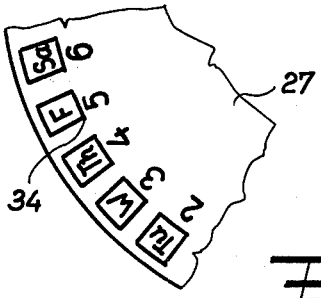
FIG. 12 is a fragmentary view in plan of the upper disc of FIG. 11 employing viewing apertures.

An alternative embodiment is shown in FIG. 12. In such last embodiment, the upper disc 27 fully covers the lower disc 31, and for reading members of the scale of names of days 30, there are provided view slits or openings 34 in the upper disc 27.

The calendar, according to the invention, is employed as follows:

Let us assume that one wishes to know the day of the week on which Aug. 12, 1979 falls. In the table in FIG. 9 one finds out that the value of the code marking of August 1979 is 1. Then the lower disc 9 is to be turned by means of the knob 16 (or by the carrier 19) into the position in which the digit 1 is seen in the view slit 13. In this way the upper disc 1 (or dial 8) and the lower disc 9 are set up in such a mutual position that the scales 3 and 10 form a calendar of the whole month of August 1979. Then one can read in the view slit 2 at the digit 12 on the scale 3 that Aug. 12, 1979 fell on a Sunday. It is evident, that one may also read immediately similar information concerning the other days of August, 1979.

By a movement of the members of scales there is meant, not only a mutual movement of symbols of scales as they are drawn in figures, i.e. in a graphical way, but such a calendar may be also carried out in other ways: individual symbols may be replaced by electric contacts or electronic elements, by which the respective function may be performed. Also the scales 3 and 10 may be disposed remote from the scale 12.

Although the invention is illustrated and described with reference to preferred embodiments thereof, it is expressly understood that it is in no way limited to the disclosure of such preferred embodiments, but it is capable of numerous modifications within the scope of the appended claims.

We claim:

1. A universal calendar comprising two superimposed members with rows of scales of digital calendar data and names of days comprising an upper member on which there is arranged a row of 31 view slits with respective members of a row of digital calendar data divided into two parts, the first part of which comprises 17 members in a row on one circle, and the other part of which comprises 14 members disposed in a row on a seconc circle, the other of said two members being a lower member on which there is arranged a scale of names of days divided into two parts having different numbers of members, respectively, disposed in a row on the same circles as the view slits on the upper member; the upper and lower members are concentric disks the view slits and digital calendar data being disposed on the circumference of the upper disk and being circumferentially divided into two parts, the first part comprising an odd number of members being situated on a first circle having a first diameter, and the other part comprising an even number of the remaining view slits and calendar data up to 31, situated on a second circle having a diameter different from that of the first circle, the other of said two disks being a lower disk on which there is arranged a scale of names of days, said scale of names of days being circumferentially divided into two parts each part having six members more than the respective part of the scale of digital calendar data and view slits on identical circles of the same diameter as the view slits and digital calendar data on the upper disk, the view slits for names of days are disposed on the circumference of the upper disk in a system of 31 orientation divisions, and on the upper disk there are also disposed view slits for members of a calendar code, the value of which for the desired month and year is disposed in a tabular manner on a visible surface of the calendar, and on the lower disk there is arranged a scale of names of days, such scale being circumferentially divided in two parts having 23 and 20 members, respectively on identical circles of the same diameter as the view slits on the upper disk and being disposed in a system of 31 orientation divisions, and on the lower disk there are disposed seven members of the calendar code, in the upper disk there is arranged a view slit for reading the definite member of the calendar code in which Monday is represented by a digit 5, Tuesday by 3, Wednesday by 1, Thursday by 6, Friday by 4, Saturday by 2, Sunday by 0, such digits being disposed on the lower disk.

2. A universal calendar as in claim 1, wherein the first part of the row of view slits comprises an odd number of slots situated on an inner circle, and the other part of the row of view slots comprises an even number of the remaining view slots up to 31 disposed on an outer circle.

3. A universal calendar as in claim 1, wherein the first part of the row of view slits comprises an odd number of view slots disposed on an outer circle, the other part of the row of view slots comprising an even number of remaining view slots up to a total of 31 situated on an inner circle.

4. A universal calendar as in claim 1, wherein the upper disk is a watch dial.

5. A universal calendar as in claim 4, wherein the lower disk is fixed to the revolving carrier of the watch glass, and the lower disk revolves with respect to the watch housing.

6. A universal calendar as in claim 5, wherein the lower disk is connected to a knob on the outer watch housing.

7. A universal calendar as in claim 1, wherein the scale of names of days is arranged on the lower disk concentrically with the upper disk, the names of days being disposed on concentric circles of the same diameter as the view slits, both parts of the scale of the names of days continuously linking up to the other in the location of the transition of the first part of the view slits to the other part of the view slits.

8. A universal calendar as in claim 1, comprising a mechanism for indicating the actual day which comprises a date pointer.

9. A universal calendar as in claim 8, wherein the calendar is disposed on a watch, and the date pointer is provided with a mechanism for mutual movement with respect to the watch mechanism.

10. A round calendar as in claim 9, wherein the watch is provided with a watch glass mounted on a revolving carrier, and the revolving carrier is provided with a single-direction claw.

11. A universal calendar as in claim 1, wherein the calendar is disposed on a watch having a watch glass, and comprising digits of the calendar code arranged on a revolving carrier of the watch glass.

* * * * *